US005251648A

United States Patent [19]

Ogawa et al.

[11] Patent Number: 5,251,648

[45] Date of Patent: Oct. 12, 1993

[54] METHOD FOR PLUMPING AND MOISTURE REGULATING CUT TOBACCO

[75] Inventors: Takashi Ogawa; Masaru Sakuma; Masami Nakamura; Katsuhiko Kan; Mitsuru Chujo, all of Hiratsuka, Japan

[73] Assignee: Japan Tobacco Inc., Tokyo, Japan

[21] Appl. No.: 770,351

[22] Filed: Oct. 3, 1991

[30] Foreign Application Priority Data

Oct. 4, 1990 [JP] Japan ..... 2-265061

[51] Int. Cl.[5] ..... A24B 3/18; A24B 3/02

[52] U.S. Cl. ..... 131/291; 131/296; 131/300; 131/903

[58] Field of Search ..... 131/291, 290, 296, 300, 131/303, 903-906

[56] References Cited

U.S. PATENT DOCUMENTS 3,575,178 4/1971 Stewart ..... 131/140
4,202,357 5/1980 de la Burde ..... 131/140
4,452,256 6/1984 Wochnowski et al. ..... 131/303

FOREIGN PATENT DOCUMENTS 49-1879 1/1974 Japan .
58-5028 1/1983 Japan .
2033208 5/1980 United Kingdom .
2142519 1/1985 United Kingdom .

*Primary Examiner*—V. Millin
*Assistant Examiner*—J. Doyle
*Attorney, Agent, or Firm*—Nixon & Vanderhye

[57] ABSTRACT

A method of plumping cut tobacco includes impregnating the cut tobacco with an adjuvant plumping agent and forcing the adjuvant plumping agent to expand in order to inflate the tissues of cut tobacco (plumping step), idly storing the plumped tobacco with a low moisture content level (idle storage step) and remoisturizing the cut tobacco after the idle storage step by adding moisture to achieve a predetermined final moisture content level (moisture content regulating step). With such a method, cut tobacco can be remarkably plumped before it is used for cigarette production.

5 Claims, 6 Drawing Sheets

METHOD FOR PLUMPING AND MOISTURE REGULATING CUT TOBACCO

BACKGROUND OF THE INVENTION

1. Field of the Invention

This invention relates to a method of plumping (inflating) cut tobacco or pieces of finely cut tobacco leaves.

More particularly, it relates to a method of impregnating pieces of cut tobacco leaves with an adjuvant plumping agent (medium of inflation) such as carbon dioxide and subsequently forcing the adjuvant plumping agent to expand to consequently inflate the pieces of cut tobacco leaves, wherein means are provided to prevent shrinkage of the inflated tobacco and raise the extent of inflation of the final product.

2. Description of the Related Art

It has been a popular practice to impregnate pieces of dried and finely cut tobacco with an adjuvant plumping agent such as carbon dioxide under high pressure and at low temperature and subsequently exposing the cut tobacco impregnated with the plumping agent to a low pressure/high temperature atmosphere to force the adjuvant plumping agent to expand and consequently inflate the pieces of cut tobacco. The inflated pieces of cut tobacco are then appropriately mixed with unplumped cut tobacco and the blend of tobacco is wrapped by sheets of paper to produce cigarettes.

A blend of tobacco containing plumped pieces of cut tobacco offers a mild and agreeable taste. Besides, the amount of tobacco required for a cigarette can be reduced by using plumped tobacco to economize the consumption of tobacco leaves and lower the cost of cigarette production. Therefore, it is desirable to inflate pieces of cut tobacco as much as possible before they are used for cigarette production.

When plumped, cut tobacco loses its moisture and becomes very dry. Therefore, plumped cut tobacco is normally remoisturized (subjected to a moisture content regulating process) to contain moisture by 12 to 13% by weight, which is often referred to as standard moisture content. However, the remoisturized tobacco (that has undergone a moisture content regulating process) can easily shrink to partly or mostly lose the effect of a plumping process.

The extent of shrinkage of plumped cut tobacco during the moisture content regulating process can be minimized when the tobacco is exposed to a wet atmosphere having a specific humidity, e.g., a relative humidity of 60° at 20° C., so that it may gradually absorb the moisture in the atmosphere until a so-called equilibratory condition, where the percentage of moisture content of the tobacco is equalized with that of the atmosphere, is reached.

A moisture content regulating process as described above is, however, a lengthy one and may not commercially be feasible. Thus, a process as disclosed in Japanese Patent Publication Tokkou Shou Nos. 47-22800 and 49-1879 has been widely adopted in commercial cigarette production.

The process disclosed in these patent publications consists spraying a mist of very fine water drops onto plumped cut tobacco so that the tobacco may quickly absorb moisture. However, this process of accelerating the rate of moisture absorption of tobacco cannot satisfactorily resolve the problem of shrinkage and the degree of inflation of cut tobacco in the final cigarette product is inevitably limited.

SUMMARY OF THE INVENTION

It is therefore the object of the present invention to provide a commercially feasible method of limiting shrinkage of plumped pieces of finely cut tobacco leaves at low cost during a remoisturizing process in order to enhance the degree of inflation of cut tobacco in the final product.

According to the invention, the above object of the present invention is achieved by providing a method of remoisturizing plumped pieces of cut tobacco leaves comprising a step of idly storing the plumped tobacco with a relatively low moisture content of approximately 10 wt % for at least 7 days or more than 7 days and a step of remoisturizing the stored tobacco to a water content level of equal to or more than 12 wt %.

With the method according to the invention, tissues of cut tobacco move into a stable condition while they are idly stored and become less liable to shrink after a moisture content regulating process where they are remoisturized so as to exhibit a high degree of inflation of cut tobacco in the final cigarette product.

The storage period of approximately 7 days with a low moisture content level is found within a time span normally provided for stocking raw materials for cigarette production and may also be used for container transportation. As a result, it does not constitute any additional cost for cigarette production.

The degree of inflation of cut tobacco in the final cigarette product can be raised when pieces of cut tobacco are stored at a low moisture content level and for a prolong period of time. However, tissues of cut tobacco with a excessively low moisture content level can be easily broken and idle storage of cut tobacco for an unduly prolonged period can raise the cost of produced cigarettes. Therefore, a method of plumping cut tobacco according to the invention is inevitably accompanied by limitations in terms of both moisture content level and storage period if it should be implemented for commercial purposes.

At least 7 days are required for storing cut tobacco with a moisture content level of lower than 10 wt % to attain a degree of inflation higher than a conventionally available level in the final product. These conditions are, however, found within the commercial limitations as cited above.

The specific condition for remoisturizing cut tobacco of a relative humidity of 60% at 20° C. as cited above should be strictly maintained for approximately 10 days if satisfactorily plumped cut tobacco should be produced and therefore it may not be commercially feasible.

A method of remoisturizing cut tobacco according to the invention, on the other hand, can be satisfactorily implemented without being subject to such rigorous limitations. With a method according to the invention, cut tobacco only needs to be stored with a relatively low moisture content of approximately 10 wt % as described above and the ambient air does not need to be controlled during the storage period. The process of remoisturizing the stored cut tobacco can effectively be conducted simply by spraying fine drops of water. Therefore, a method according to the invention is totally free from commercial limitations as cited above.

The moisture content level of cut tobacco being stored for the purpose of the present invention is preferably kept equal to or greater than 5 wt %.

For the purpose of the present invention, plumped and almost completely dried cut tobacco may be mixed with unplumped cut tobacco to a predetermined ratio so that the moisture in the unplumped cut tobacco may be absorbed by the plumped and dried cut tobacco to show a desired moisture content level before the mixture is stored for a certain period of time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
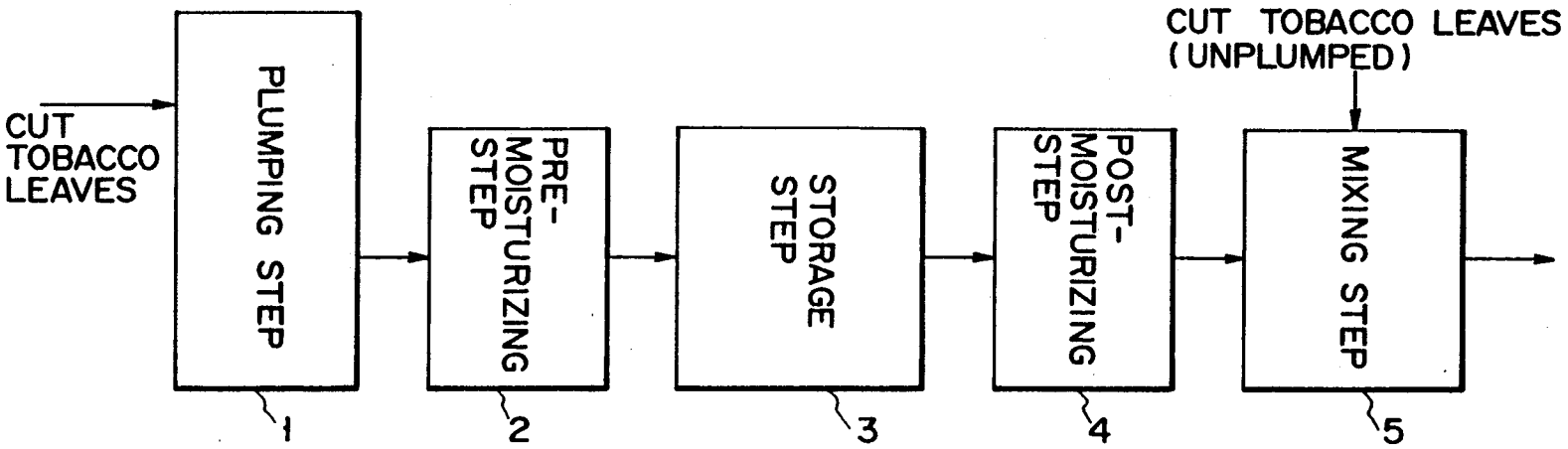
FIG. 1 is a flow chart of a first embodiment of the invention, showing schematically the steps it comprises.

The present invention will now be described by way of its preferred and exemplary embodiments. FIG. 1 is a flow chart of a first embodiment of the invention, showing schematically the steps it comprises.

Reference numeral 1 in FIG. 1 denotes a plumping step. In this plumping step 1, pieces of cut tobacco leaves are inflated. More specifically, pieces of cut tobacco are immersed in and impregnated with liquidated carbon dioxide under high pressure and at low temperature. The cut tobacco impregnated with carbon dioxide is heated under low pressure to force the carbon dioxide to expand so that the expanded carbon dioxide in turn inflates the pieces of cut tobacco.

In the plumping step 1, the moisture contained in the cut tobacco is removed until the moisture content level of the cut tobacco after the plumping step 1 becomes approximately 3% by weight and therefore the cut tobacco is almost completely dried.

Plumped but dried tobacco is then moisturized in a pre-moisturizing step 2 until it attains a given moisture level. This moisturizing step 2 may be conducted, for instance, by spraying a mist of very fine drops of water onto the dried tobacco.

The purpose of this pre-moisturizing step 2 is to prevent undesirable fragmentation of tobacco in the subsequent steps. Pieces of dried tobacco that have passed through the pre-moisturizing step 2 are very fragile and can be easily fragmented when they are transported or otherwise handled. Fragmented tobacco can give rise to various troubles when wrapped in sheets of paper to produce cigarettes. Preferably, the moisture content level of cut tobacco is maintained to higher than 5 wt % to avoid the problem of fragmentation, although it may be below 5 wt % or it may be totally omitted if sufficient care is taken to prevent fragmentation of cut tobacco until a post-moisturizing step, which will be described later. On the other hand, plumped cut tobacco is moisturized by spraying a mist of fine drops of water to contain moisture to a level of approximately 12 wt % in a later stage before it is mixed with unplumped cut tobacco. Therefore, the level of moisture content in the storage step should not be higher than 12 wt %. Thus, cut tobacco should contain moisture by 5 to 12 wt % at the storage step 3.

As described earlier, however, the lower the level of moisture content of cut tobacco during the storage step 3, the greater the extent of inflation of the tobacco in the final product of cigarettes. In view of this fact, the moisture content level of cut tobacco in the storage step 3 should be kept below 10 wt % to produce cigarettes of satisfactorily plumped cut tobacco.

It should be stressed, therefore, that the moisture content level of cut tobacco in the storage step 3 is preferably maintained between 5 and 10 wt % in order to maximize the degree of inflation of pieces of cut tobacco in the final cigarette product and optimize the condition where they are handled.

After the pre-moisturizing step 2, moisturized cut tobacco is stored for a given period of time in a storage step 3. This period of storage in the storage step 3 is between 7 and 30 days. During this period, cut tobacco is stored in a plumped state until the tissues of the cut tobacco are stabilized in that state so that the tobacco may pass a post moisturizing step with the least degree of shrinkage before being wrapped in sheets of paper to produce cigarettes. It should be noted here that the lower the moisture content level of cut tobacco and the longer the period of storage in the storage step 3, the greater is the degree of stabilization of tobacco tissues and the smaller the extent of shrinkage of cut tobacco in a post-moisturizing step that follows. The moisture content level of cut tobacco in the storage step 3 is preferably maintained between 5 and 10 wt % in this embodiment in order to maximize the degree of inflation of pieces of cut tobacco in the final product and optimize the condition where they are handled. If the storage step for storing cut tobacco lasts very long, it entails an enhanced cost for manufacturing cigarettes using such tobacco. On the other hand, the tissues of stored cut tobacco will not be satisfactorily stabilized. If the period of the storage step is very short. The duration of the storage step is selected to be between 7 and 30 days in this embodiment.

Figure 4:
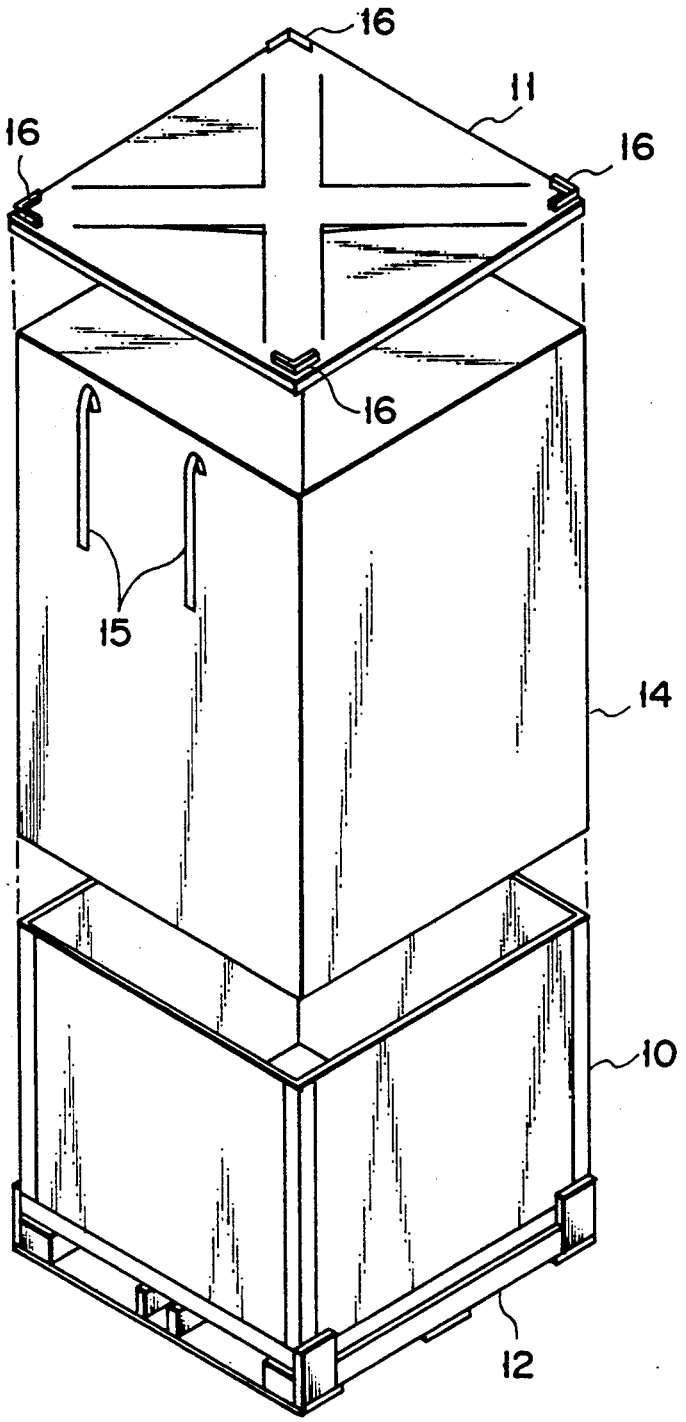
FIG. 4 is an exploded perspective view of a container that may be used for the storage step of the method of the invention.

FIG. 4 illustrates a storage container for storing cut tobacco in the storage step 3 for the purpose of the present invention. The storage container comprises a container main body 10 and a lid 11. When closed, the container substantially forms a cube having edges which are approximately 1 m long. An dampproof bag 14 is housed in the container main body 10. The dampproof bag 14 is made of a film of a dampproof material such as synthetic resin and used to contain cut tobacco therein. The damp-proof bag is provided at its upper portion with a number of tying bands 15 so that it may be sealed when its upper portion is folded and matching pairs of the bands are tied together. The container main body 10 is provided under the bottom with a pallet 12 which is integral with the main body 10 so that the storage container may be easily moved by a fork lift or similar transportation means. Projections 16 are arranged at the four corners of the lid 11 to hold the bottom of another container which is placed on it.

A storage container having a configuration as described above can be used to transport cut tobacco during the storage step 3 so that any prolonged storage period may be effectively eliminated for the cut tobacco. The installation to be used for a cut tobacco plumping step 1 can be very large particularly when it involves equipment for plumping cut tobacco by means carbon dioxide. Cut tobacco should be processed at a very high rate in such an installation if it is operated on an economically feasible basis. A large volume of plumped cut tobacco produced from such an installation may then need to be distributed to several remotely located plants where cut tobacco is wrapped with sheets of paper to produce cigarettes. In such a case, containers as described above may be effectively used for storing and transporting plumped tobacco at the same time, the time required for transportation constituting part of the period of the storage step 3 to reduce the overall period required for idly storing cut tobacco for the purpose of the present invention.

The cut tobacco that has been stored for a given period of time in the storage step 3 is then fed to a post-moisturizing step 4, where the cut tobacco is moisturized to contain moisture to a so-called standard equilibratory moisture content level of typically 12 wt %. In this post-moisturizing step 4, cut tobacco is moisturized by spraying a mist of fine drops of water into the tobacco.

The cut tobacco that has been stored for a given period of time in the storage step 3 is protected against undesirable shrinkage in the post-moisturizing step 4. Thus, the pieces of the cut tobacco remain in a plumped state when they are wrapped in sheets of paper to produce the final cigarette product, making the unit output of tobacco processed by a method according to the invention far bulkier than a comparable unit output of tobacco processed by a conventional method.

The cut tobacco that has passed through a post-moisturizing step 4 is then fed to a mixing step 5, where it is mixed with unplumped tobacco, which is often called base cut tobacco, to a ratio of typically 20 wt %:80 wt %.

The mixture of tobacco, or composite cut tobacco, is then processed in a conventional manner to produce cigarettes.

Some of the results of a series of experiments conducted by the inventor of the prevent invention to prove the effect of the invention will now be discussed.

It should be noted here that the quality of samples of cut tobacco can inevitably show certain deviations in any experiments as tobacco is an agricultural product and the parameters for raising tobacco cannot be rigorously controlled. Consequently, the data obtained as a result of experiments using such samples are not totally free from errors.

To begin with, samples of a standard cut tobacco blend containing several varieties of tobacco were prepared and plumped by means of carbon dioxide in a manner as described earlier. The samples of plumped tobacco contained approximately 3 wt % moisture and therefore were very dry. Then, the dry samples were divided into three groups; those that were not subsequently moisturized, those that were subsequently moisturized to contain moisture by 6 wt % and those that were moisturized to contain moisture by 12 wt %. The samples were then stored and thereafter moisturized by spraying a mist of fine drops of water until they all came to contain 12 wt % moisture.

Figure 5:
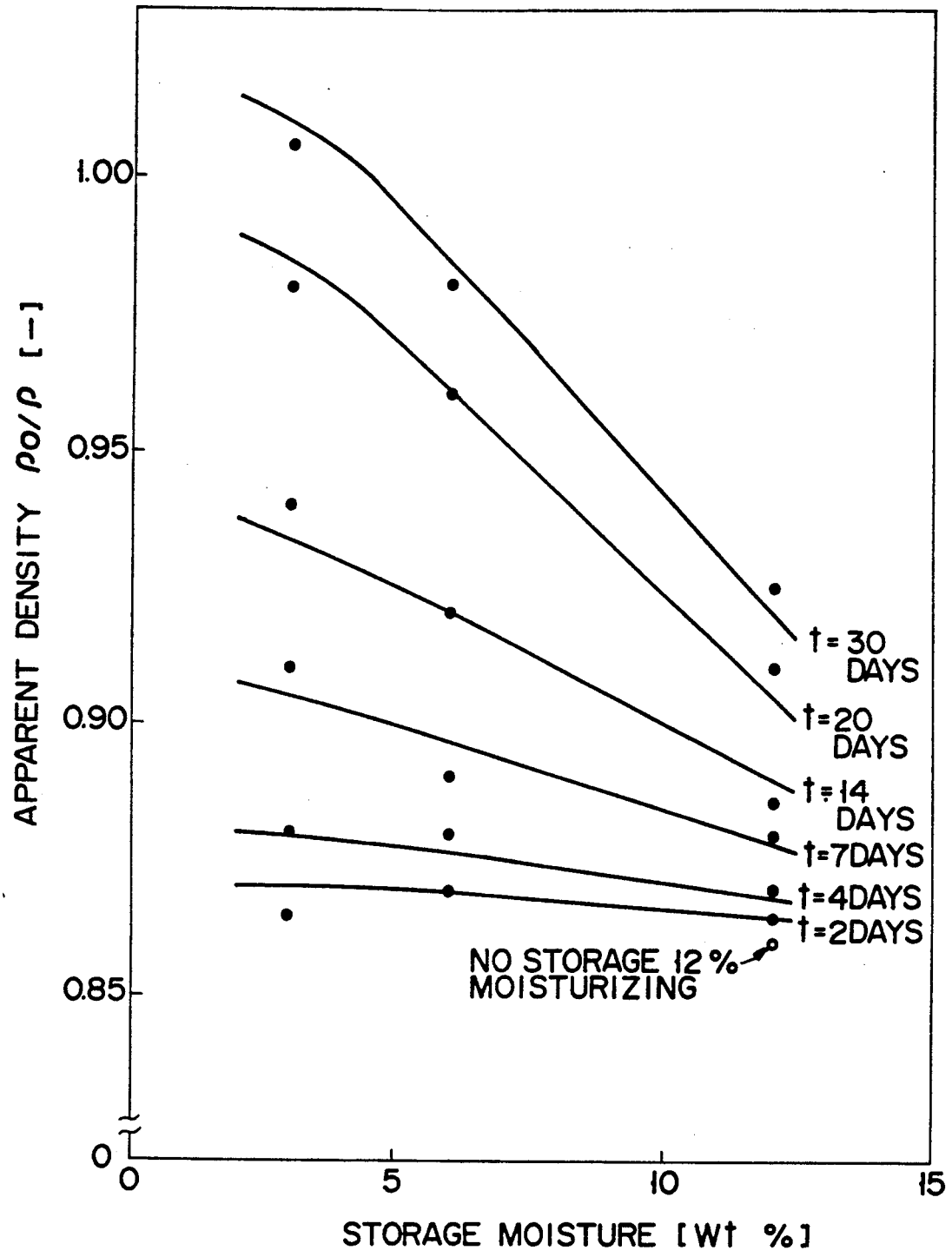
FIG. 5 is a graph showing the relationship among the moisture content level, the storage period and the apparent density of cut tobacco which is being stored for the purpose of the present invention.

Thereafter, the samples of each group were measured for apparent density o and the measured values were compared with the apparent density $o_o$ of a control that had been prepared by exposing a given amount of plumped tobacco to an atmosphere with a relative humidity of 60% at 20° C. for approximately 10 days and then gradually moisturizing to a so-called standard equilibratory moisture content level. Table 1 below shows the values of $o_o/o$ for different groups and for different stages of the storage step 3. FIG. 5 is a graphic illustration of the values of Table 1. The apparent density was determined for each sample by containing the cut tobacco of the sample in a container having a given volume and then filling the container with a liquid that do not wet the tobacco to find out the volume of the tobacco per se. The weight of the sample was then divided by the volume to determine the weight per unit volume of the sample. Note that the cut tobacco of the samples containing 12 wt % of moisture and stored for 0 day in Table 1 corresponds to cut tobacco which is moisturized by spraying mist of water drops to a moisture content level of 12 wt % without being subjected to a storage step.

TABLE 1

| | moisture content level during storage (w %) | | |
|---|---|---|---|
| days of storage | 3% | 6% | 12% |
| 0 | — | — | 0.860 |
| 2 | 0.865 | 0.870 | 0.866 |
| 4 | 0.880 | 0.879 | 0.871 |
| 7 | 0.912 | 0.891 | 0.882 |
| 14 | 0.942 | 0.918 | 0.887 |
| 20 | 0.980 | 0.963 | 0.910 |
| 30 | 1.006 | 0.980 | 0.937 |

As is apparent from Table 1 and FIG. 5, any of the samples that had experienced a storage step showed an apparent density which is smaller than the tobacco treated in a conventional manner regardless of the moisture content level during the storage step. It should be noted here, however, any cut tobacco should be moisturized to contain moisture by 12 to 13 wt % in order for the tobacco to show a desired moisture content level before it is wrapped in sheets of paper to produce cigarettes. Therefore, it is pointless to moisturize cut tobacco to a moisture content level of greater than 12 wt % before it is stored. At the same time, as seen from FIG. 5, such a high moisture content level of cut tobacco during the storage step can result in a small apparent density of the cut tobacco Therefore, the moisture content level should be kept below 12 wt % for cut tobacco in the storage step.

It may also be seen from FIG. 5 that the lower the moisture content level of cut tobacco and the longer the period of storage in the storage step, the lower the apparent density of the cut tobacco becomes. The value of $o_o/o$ is greater than 1 particularly when cut tobacco is made to contain 3 wt % moisture and stored for 30 days in the storage step, meaning that such cut tobacco has an apparent density smaller than that of the control. On the other hand, it should also be noted that the lower the moisture content level of cut tobacco in the storage step, the higher will be the risk of fragmentation of the tobacco in the subsequent processing steps. Thus, it is desirable in practical applications to raise the moisture content level by a certain extent during the storage step to minimize the risk of fragmentation and prolong the period of storage step to compensate for the reduction in the apparent density due to the raised moisture content level. It is seen from FIG. 5 that cut tobacco with a long storage time shows a sharp decline in the value $o_o/o$ as a function of the moisture content level in the storage step. While the decline is not sharp for those lines with a storage period of several days, it becomes remarkably sharp for the lines with a storage period equal to or greater than 7 days. Therefore, the duration of the storage step should be equal to or greater than 7 days for practical applications.

While the apparent density of the tobacco per se was determined for each of the specimens in the above experiments, the bulkiness per unit weight of cut tobacco will be obviously a more important factor in commercial cigarette manufacturing if the rate of consumption of cut tobacco is to be minimized for a unit number of cigarettes, considering that a huge number of gaps are distributed among pieces of tobacco in each cigarette. The bulkiness of cut tobacco is normally expressed in terms of the number of standard cigarettes that can be produced from a unit weight, e.g., 1 kg, of cut tobacco.

Figure 6:
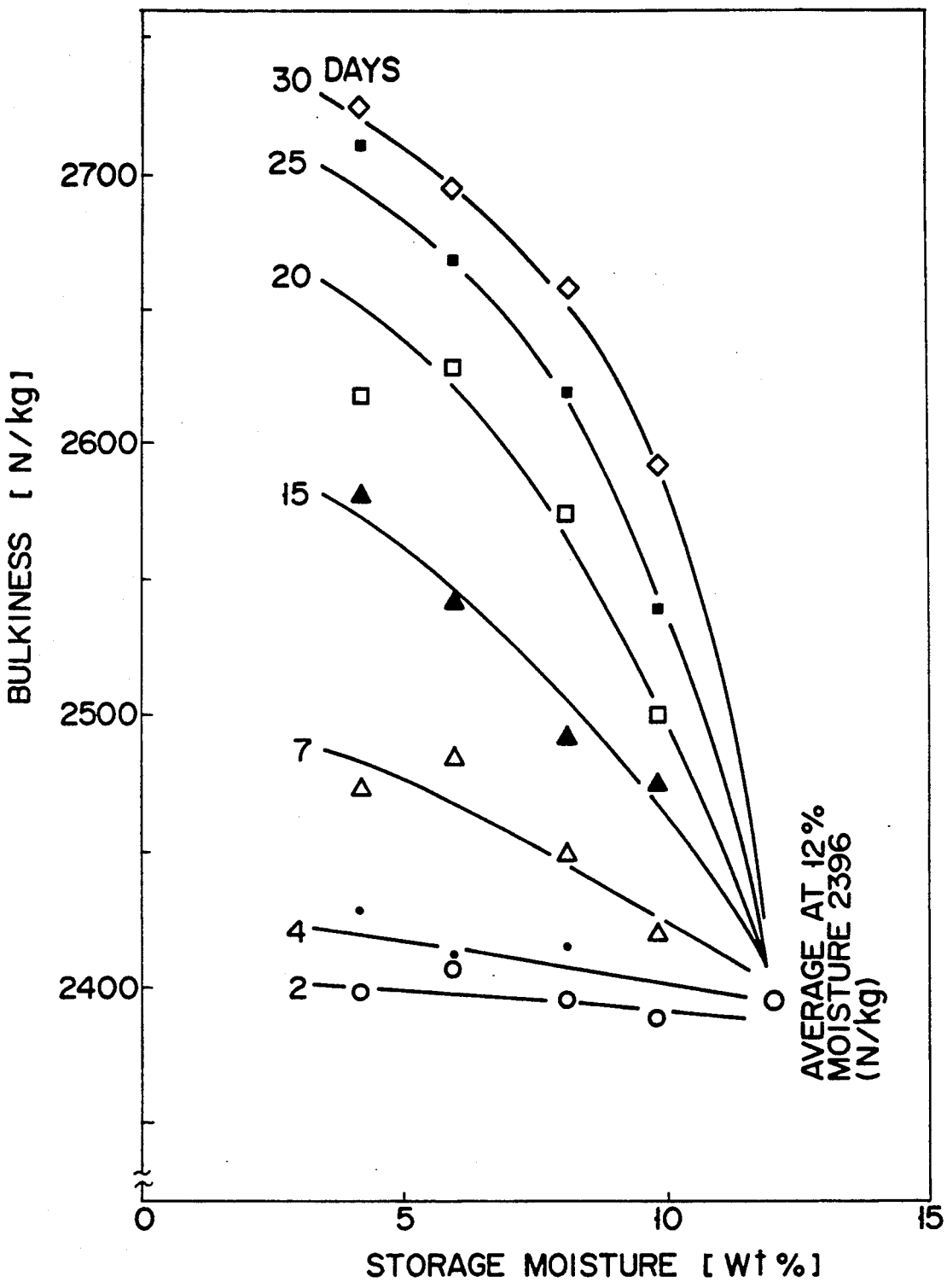
FIG. 6 is a graph showing the relationship among the moisture content level, the storage period and the bulkiness of cut tobacco which is being stored for the purpose of the present invention.

Table 2 below shows the bulkiness of the specimens prepared in a manner similar to those of Table 1. In each column of Table 2, the upper figure indicates the number of cigarettes produced from a unit weight of the specimen and the lower figure is obtained by dividing the upper figure by 2,397 which is the average number of cigarettes produced from a unit weight of cut tobacco containing moisture by 12.1 wt % during storage. FIG. 6 is a graphic illustration of the values of Table 2.

TABLE 2

| | moisture content level during storage (wt %) | | | | |
|---|---|---|---|---|---|
| days of storage | 4.2 | 6.0 | 8.1 | 9.8 | 12.1 |
| 0 | | | | | 2,386 |
| | | | | | 0.995 |
| 2 | 2,399 | 2,407 | 2,396 | 2.388 | 2,381 |
| | 1.001 | 1.004 | 1.000 | 0.996 | 0.993 |
| 4 | 2,428 | 2,412 | 2,415 | 2,391 | 2,391 |
| | 1.013 | 1.006 | 1.008 | 0.997 | 0.997 |
| 7 | 2,473 | 2,486 | 2,449 | 2,420 | 2,402 |
| | 1.032 | 1.037 | 1.022 | 1.010 | 1.002 |
| 15 | 2,582 | 2,544 | 2,492 | 2,475 | 2,380 |
| | 1.077 | 1.061 | 1.040 | 1.033 | 1.010 |
| 20 | 2,6191 | 2,629 | 2,574 | 2,500 | 2,420 |
| | 1.093 | 1.097 | 1.074 | 1.043 | 1.010 |
| 25 | 2,711 | 2,669 | 2,619 | 2,539 | 2,396 |
| | 1.131 | 1.113 | 1.093 | 1.059 | 1.000 |
| 30 | 2,724 | 2,695 | 2,658 | 2,592 | 2,420 |

TABLE 2-continued

| | moisture content level during storage (wt %) | | | | |
|---|---|---|---|---|---|
| days of storage | 4.2 | 6.0 | 8.1 | 9.8 | 12.1 |
| | 1.136 | 1.124 | 1.109 | 1.081 | 1.010 |

As is apparent from Table 2 and FIG. 6, the bulkiness of cut tobacco which is plumped and moisturied by a method according to the invention shows a tendency similar to or more conspicuous than that of the apparent density as discussed earlier. Besides, it should be noted that the cut tobacco containing moisture by 12.1 wt % did not show any remarkable improvement in the bulkiness if it was stored for a prolonged period of time, meaning that cut tobacco should be stored with a moisture content level lower than 12 wt % which is a standard equilibratory level and preferably lower than 10 wt % if a satisfactory improvement of bulkiness should be achieved.

Tables 3 through 5 show the bulkiness of cut tobacco containing moisture by 12 wt % in the final stages but having different moisture content levels during the storage step.

TABLE 3

| | moisture during storage - 3.0 wt % | | |
|---|---|---|---|
| | moisturized by | moisturized by water drops | |
| days of storage under sealed condition | air with 60% r.h. at 20° C. (n. of cgts/kg) | moisture level after moisturization | bulkiness (number of cgts/kg) |
| 0 | 2,520 | 11.3 | 2,413 |
| 14 | 2,617 | 13.0 | 2,533 |
| 28 | 2,608 | 14.0 | 2,497 |

TABLE 4

| | moisture during storage - 4.4 wt % | | |
|---|---|---|---|
| | moisturized by | moisturized by water drops | |
| days of storage under sealed condition | air with 60% r.h. at 20° C. (n. of cgts/kg) | moisture level after moisturization | bulkiness (number of cgts/kg) |
| 0 | 2,463 | 12.1 | 2,309 |
| 14 | 2,467 | 12.8 | 2,394 |
| 28 | 2,530 | 11.9 | 2,473 |

TABLE 5

| | moisture during storage - 5.7 wt % | | |
|---|---|---|---|
| | moisturized by | moisturized by water drops | |
| days of storage under sealed condition | air with 60% r.h. at 20° C. (n. of cgts/kg) | moisture level after moisturization | bulkiness (number of cgts/kg) |
| 0 | 2,470 | 11.6 | 2,423 |
| 14 | 2,558 | 12.5 | 2,490 |
| 28 | 2,584 | 13.9 | 2,510 |

The cut tobacco used for the above tables was moisturized by either exposing to an atmosphere with a relative humidity of 60% at 20° C. or spraying mist of fine water drops. Tables 3, 4 and 5 respectively represent moisture content levels of 3.0 wt %, 4.4 wt % and 5.7 wt % in the storage step. It is apparent from these tables that cut tobacco moisturized slowly by exposing to an atmosphere with a relative humidity of 60% shows a high degree of bulkiness, although such a process of moisturization is time consuming and therefore may not be feasible in commercial applications.

Tables 7 and 8 below show some of the results of experiments conducted by using two different varieties of tobacco. The cut tobacco used for Table 6 was prepared by using only Yellow BL2, whereas the cut tobacco of Table 7 was Burley LB4. In both cases, the cut tobacco moisturized slowly by exposing to a wet atmosphere with a high relative humidity showed a higher degree of bulkiness.

TABLE 6

| | Yellow LB2 | | |
|---|---|---|---|
| | moisture during storage - 5.0 wt % | | |
| | moisturized by | moisturized by water drops | |
| days of storage under sealed condition | air with 60% r.h. at 20° C. (n. of cgts/kg) | moisture level after moisturization | bulkiness (number of cgts/kg) |
| 0 | 2,038 | 12.7 | 1,974 |
| 30 | 2,190 | 13.8 | 2,120 |

TABLE 7

| | Burley LB4 | | |
|---|---|---|---|
| | moisture during storage - 4.1 wt % | | |
| | moisturized by | moisturized by water drops | |
| days of storage under sealed condition | air with 60% r.h. at 20° C. (n. of cgts/kg) | moisture level after moisturization | bulkiness (number of cgts/kg) |
| 0 | 2,800 | 10.1 | 2,698 |
| 30 | 2,830 | 11.4 | 2,808 |

Figure 2:
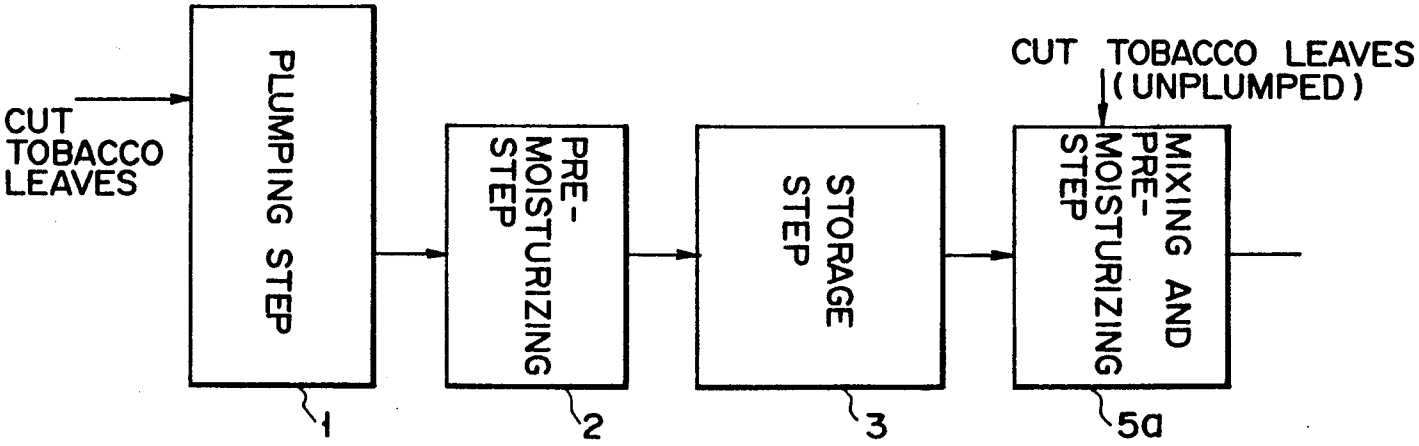
FIG. 2 is a flow chart of a second embodiment of the invention, showing schematically the steps it comprises.

FIG. 2 shows flow chart of a second embodiment of the invention, illustrating schematically the steps it comprises. This embodiment does not have a post-moisturizing step 4 as in the case of the first embodiment and therefore the cut tobacco that has been subjected to a storage step is directly mixed with unplumped tobacco so that the moisture contained in the latter is partly transferred to the former.

The second embodiment of the method of the invention is economical and advantageous in that a post-moisturizing step is omitted. Moreover, the improvement of bulkiness of tobacco will be remarkable since cut tobacco is moisturized for this embodiment in a manner slower than spraying water drops to tobacco. However, cut tobacco processed by way of this embodiment can be fragmented and consequently lose its bulkiness as it passes through feeders and a mixer in an unmoisturized and dry state. Besides, it can be adversely affected by a low moisture storage step as well as by a wrapping machine to deteriorate its flavor and by turn degrade the final product of cigarettes produced from it after being mixed with unplumped tobacco. In order to avoid these and other problems, care should be taken so that the moisture content level of cut tobacco is preferably held above 5 wt % in a pre-moisturizing step and that the blend of the plumed tobacco that has passed a storage step and unplumped tobacco contains moisture by approximately 12 wt %, if this second embodiment is used.

Now, some of the results of a series of experiments conducted by using the second embodiment of the method of the invention will be discussed.

In Table 8, specimens of cut tobacco having different moisture content levels in the storage step are compared before and after passing through a feeder and a mixer in terms of moisture content, particle size and bulkiness. The table shows that, when each of the specimens was put on a sieve having a 1.5 mm square mesh screen, the ratio of the portion of the specimen that passed through the sieve to the remaining portion was greater if the moisture content level in the storage step was lower, meaning that cut tobacco stored with a low moisture content level in a storage step can be readily fragmented in the storage and subsequent steps. It also shows that cut tobacco that has been fragmented by a feeder and a mixer remarkably lose its bulkiness. On the other hand, it is obvious that a low moisture content level of cut tobacco in the storage step plays a significant role to improve the bulkiness of the cigarettes produced from the tobacco, meaning that the moisture content level of cut tobacco should preferably be low if the second embodiment is used for cigarette production.

TABLE 8

| moisture [wt %] | | portion passing 1.5 mm mesh (%) | | bulkiness [cgts/kg] | |
|---|---|---|---|---|---|
| before | after | before | after | before | after |
| 4.5 | 5.6 | 33.0 | 40.3 | 2,630 | 2,540 |
| 7.5 | 8.2 | 31.0 | 33.0 | 2,534 | 2,506 |
| 9.5 | 10.3 | 29.2 | 29.5 | 2,511 | 2,483 |
| 11.5 | 12.2 | 26.7 | 26.8 | 2,379 | 2,381 |

In actual cigarette manufacturing, the performance of the wrapping machine and the flavor of the produced cigarettes constitute important factors of assessment. Table 9 below shows some of the results of the experiments in terms of these factors. Specimens of cut tobacco having different moisture content levels were mixed with ordinary unplumped cut tobacco that had been so moisturized as to show a moisture content level of 12 wt % after mixing to a standard ratio of 20 wt %:80 wt % and then the specimens of the blend were wrapped in sheets of paper to produce cigarettes by means of a wrapping machine. The produced cigarettes were then rated by a panel of 10 tobacco connoisseurs on a 10 point basis.

TABLE 9

| moisture in storage step [wt %] | moisture after mixing [wt %] | weight of cigarette [g] | rate of wasted tobacco [g/kg] | n. of rejected cgts per $10^4$ | raging | |
|---|---|---|---|---|---|---|
| 4.5 | 12.0 | 0.652 | 23 | 13.2 | 8.0 | The higher the moisture content |
| 7.5 | 12.2 | 0.642 | 14 | 6.4 | 8.5 | level in storage step, the severer |
| 9.5 | 12.1 | 0.658 | 14 | 6.1 | 9.0 | the bitterness. Cgts with rating |
| 11.5 | 12.2 | 0.679 | 13 | 7.8 | 10.0 | below 8 are not recommended. |

As is apparent from Table 9, the lower the water content level of cut tobacco in the storage step, the greater is the rate of wasted material. So is the number of rejected cigarettes in the final product. Cigarettes whose cut tobacco had contained moisture by 4.8 wt % in the storage step were rated to be 8.0. Generally speaking, cigarettes to be marketed should be rated 8 or above.

Figure 7:
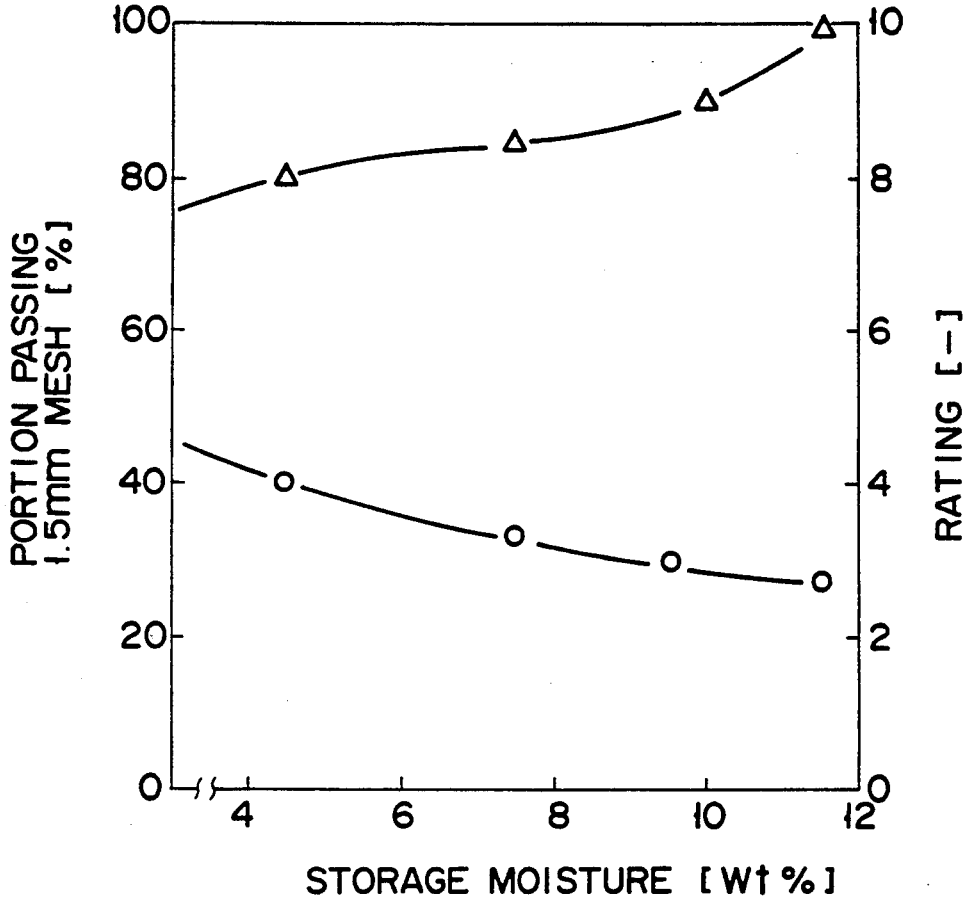
FIG. 7 is a graph showing the relationship among the moisture content level and the particle size of cut tobacco which is being stored and the rating of the taste of cigarettes produced by using the cut tobacco.

FIG. 7 is a graphic illustration of some of the results of the experiments conducted for the purpose of the second embodiment. As seen from FIG. 7, cigarettes prepared by using plumped tobacco having a moisture level of 4.5 wt % in a storage step are expected to show a rating of 8 or lower than 8 and therefore such plumped tobacco are significantly fragmented. Thus, plumped tobacco having a moisture content level of approximately 5 wt % is preferably used for the purpose of the second embodiment. It may be needless to note that the upper limit of moisture content level of plumped tobacco during a storage step is 12 wt % for the purpose of the second embodiment as in the case of the first embodiment.

Figure 3A:
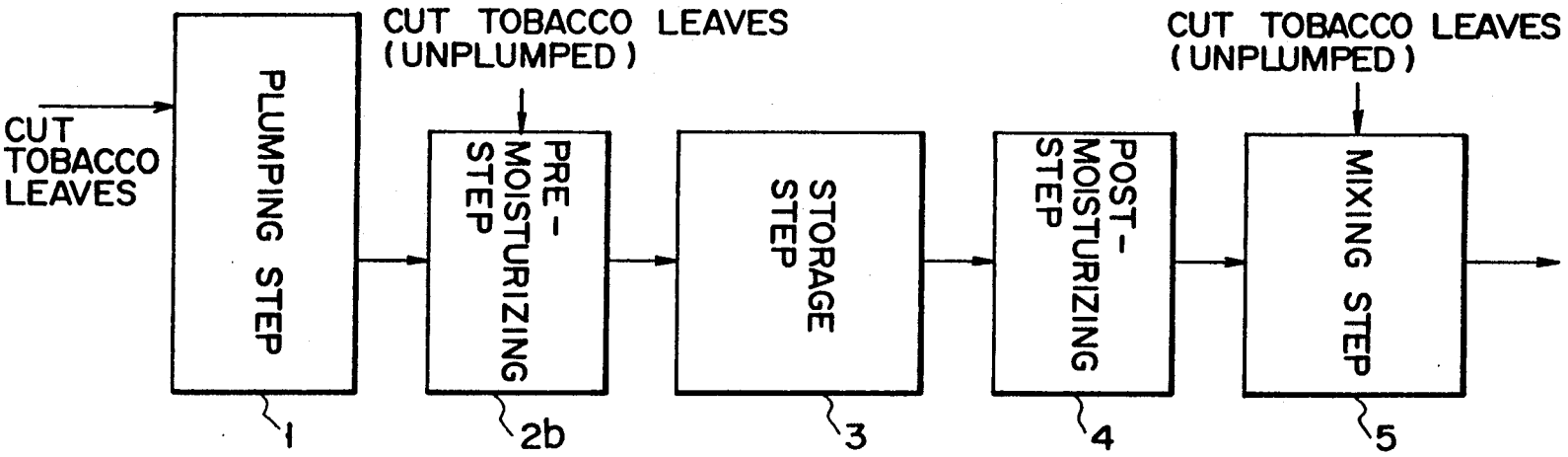
FIG. 3A is a flow chart of a third embodiment of the invention, showing schematically the steps it comprises.
Figure 3B:
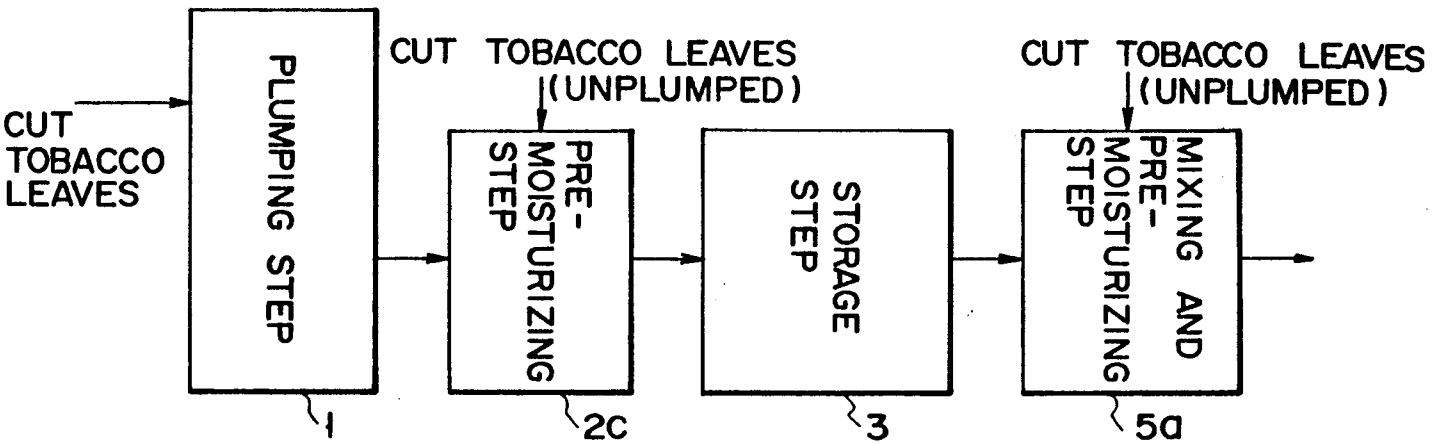
FIG. 3B is a flow chart of a fourth embodiment of the invention, showing schematically the steps it comprises.

FIGS. 3(*a*) and 3(*b*) respectively show third and fourth embodiments of the invention.

With either of these embodiments, cut tobacco that has been plumped in a plumping step 1 is mixed with unplumped cut tobacco to a predetermined ratio in a premoisturizing step 2*b* or 2*c* subsequent to the plumping step 1 so that the moisture in the unplumped tobacco may be partly transferred to the plumped tobacco in a storage step that follows. The amount of unplumped tobacco to be added to the mixture in a mixing step 5 or 5*a* is a unit amount of unplumped tobacco fed for a mixing cycle less the plumped tobacco consumed in the pre-moisturizing step 2*b* or 2*c*. The remaining part of the third and fourth embodiments is same as that of the first and second embodiments and therefore will be not be described here any further.

In either of the third and fourth embodiments, the pre-moisturizing step is carried out by mixing plumped tobacco with unplumped tobacco and therefore it is very simple.

The present invention is not limited to the above described embodiments and they may be modified appropriately within the scope of the invention. For instance, an adjuvant plumping agent other than carbon dioxide may be used for the plumping step. While the moisture content level of plumped tobacco in any of the above embodiments is preferably equal to or higher than 5 wt % in the above description, it may be lower than 5 wt % if appropriate care is taken for handling cut tobacco in the storage step and the subsequent steps. If the moisture level is set to lower than 5 wt %, the pre-moisturizing step may be omitted.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

We claim:

1. A method of plumping cut tobacco comprising:

a plumping step which includes exposing said cut tobacco to an adjuvant plumping agent to impregnate the tissues of the cut tobacco with the agent and forcing the adjuvant plumping agent to expand in order to inflate the tissues of said cut tobacco;

an idle storage step which includes idly storing the plumped tobacco with a first moisture content of less than 10 wt % for at least 7 days after the plumping step which stabilizes the tissues of the inflated cut tobacco; and a moisture-content regulating step which includes remoisturizing the cut tobacco after the idle storage step by adding moisture to the cut tobacco to achieve a predetermined second moisture content level.

2. A method of plumping cut tobacco according to claim 1, which further comprises a pre-moisturizing step which is practiced after said plumping step and before said idle storage step for regulating the moisture content of the cut tobacco to said first moisture content level suitable for said idle storage step, and wherein said moisture-content regulating step is a post-moisturizing step which is practiced after said idle storage step for regulating the moisture content of the cut tobacco to said second moisture content level equal to the moisture content level of the final product.

3. A method of plumping cut tobacco according to claim 2, wherein said plumped tobacco is mixed with unplumped tobacco at least in either said pre-moisturizing step or said post-moisturizing step in order for the moisture in the unplumped tobacco to be partly transferred to the plumped tobacco.

4. A method of plumping cut tobacco according to claim 2, wherein at least either said pre-moisturizing step of said post-moisturizing step in spraying a mist of fine water drops onto the plumped tobacco.

5. A method of plumping cut tobacco according to claim 2, wherein the moisture content of said cut tobacco is regulated to equal to or greater than 5 wt % in said pre-moisturizing step.

* * * * *